US008739434B2

(12) United States Patent
Bishop

(10) Patent No.: US 8,739,434 B2
(45) Date of Patent: Jun. 3, 2014

(54) FOOTWEAR WITH TOE ALIGNER STRUCTURE

(76) Inventor: Felicia Hwang Bishop, Barrington, RI (US)

( * ) Notice: Subject to any disclaimer, the term of this patent is extended or adjusted under 35 U.S.C. 154(b) by 727 days.

(21) Appl. No.: 13/004,850

(22) Filed: Jan. 11, 2011

(65) Prior Publication Data

US 2011/0173843 A1 Jul. 21, 2011

Related U.S. Application Data

(60) Provisional application No. 61/282,300, filed on Jan. 15, 2010.

(51) Int. Cl.
*A43B 7/26* (2006.01)
*A43B 3/12* (2006.01)
*A43B 3/10* (2006.01)

(52) U.S. Cl.
CPC ..... *A43B 3/105* (2013.01); *A43B 3/126* (2013.01); *A43B 7/26* (2013.01)
USPC ..... 36/94; 36/11.5; 36/95

(58) Field of Classification Search
CPC ..... A43B 3/105; A43B 3/126; A43B 7/26; A43B 3/10; A43B 3/101; A43B 3/102; A43B 3/12; A43B 7/14
USPC ..... 36/94, 11.5, 95
See application file for complete search history.

(56) References Cited

U.S. PATENT DOCUMENTS 35,629 A 6/1862 Rosenheimer
366,503 A 7/1887 O'Neill
611,860 A 10/1898 Hayward
730,366 A 6/1903 Gunthorp
736,194 A 8/1903 Bassett
1,098,397 A 6/1914 Pecorella
1,167,019 A 1/1916 Reed
1,175,718 A 3/1916 Crowe (Continued)

FOREIGN PATENT DOCUMENTS

DE 202008008106 U1 12/2009
EP 0152033 A1 8/1985

(Continued)

OTHER PUBLICATIONS

European Search Report (from EP Appl. No. 11 73 3294), Jul. 16, 2013.

*Primary Examiner* — Ted Kavanaugh
(74) *Attorney, Agent, or Firm* — Law Office of Peter G. Korytnyk, PLLC

(57) ABSTRACT

Wellness footwear that promotes proper gait and strong feet is provided. The footwear can include a sole. The footwear can also include a securing upper arranged with the sole and configured to securely hold a foot of a user on a footbed so as to substantially prevent lateral movement of the foot with respect to the footbed and allow one or more of a big toe and remaining toes of the user to be at least partially uncovered and exposed. A toe aligner structure can be arranged between the securing upper and the sole and configured to extend between the big toe and remaining toes of the user so as to direct a force against the big toe in a direction away from the remaining toes during standing, walking, running, swimming, and other movements when muscles of the foot are in use.

12 Claims, 9 Drawing Sheets

(56) References Cited

U.S. PATENT DOCUMENTS

| | | | | |
|---|---|---|---|---|
| 1,402,375 | A | 1/1922 | Parisi | |
| 1,554,883 | A * | 9/1925 | Sahlin | 602/30 |
| 1,624,171 | A | 4/1927 | Johnson | |
| 2,075,552 | A | 3/1937 | Stemmons | |
| 2,510,654 | A | 6/1950 | Pepin | |
| 2,511,101 | A | 6/1950 | Clarke | |
| 2,539,557 | A | 1/1951 | Stroup | |
| 2,542,319 | A | 2/1951 | Ferri | |
| 2,575,867 | A | 11/1951 | Ferri | |
| 2,575,868 | A | 11/1951 | Ferri | |
| 2,740,207 | A | 4/1956 | Starensier | |
| 2,954,617 | A | 10/1960 | Yamaguchi | |
| 3,013,564 | A | 12/1961 | Levey | |
| 3,275,002 | A * | 9/1966 | Scholl | 36/140 |
| 3,299,894 | A | 1/1967 | Charlebois | |
| 4,017,987 | A * | 4/1977 | Perez et al. | 36/11.5 |
| 4,207,880 | A * | 6/1980 | Zinkovich | 602/30 |
| D288,742 | S | 3/1987 | Caretti | |
| 4,745,927 | A | 5/1988 | Brock | |
| 5,437,616 | A | 8/1995 | Kasahara | |
| D465,642 | S | 11/2002 | Petrovski | |
| D465,906 | S | 11/2002 | Petrovski | |
| 7,082,703 | B2 | 8/2006 | Greene et al. | |
| 7,676,850 | B2 | 3/2010 | Steel | |
| 2003/0172555 | A1 | 9/2003 | Chu | |
| 2005/0229430 | A1 | 10/2005 | Takaba | |
| 2007/0011815 | A1 | 1/2007 | Fraser et al. | |
| 2008/0086913 | A1 | 4/2008 | Nawachi et al. | |
| 2008/0115386 | A1 | 5/2008 | Geuss | |
| 2009/0038181 | A1 | 2/2009 | Loughnane | |
| 2009/0113759 | A1 | 5/2009 | Heid | |
| 2009/0133289 | A1 * | 5/2009 | Cantoni | 36/101 |
| 2011/0035962 | A1 * | 2/2011 | Sabounjian | 36/94 |

FOREIGN PATENT DOCUMENTS

| | | | |
|---|---|---|---|
| FR | 2624355 | A1 | 6/1989 |
| GB | 2428960 | B | 7/2008 |
| JP | 3009079 | U9 | 1/1995 |
| JP | 2005230492 | A | 9/2005 |
| WO | 8901745 | A1 | 3/1989 |
| WO | 2005115189 | A1 | 12/2005 |
| WO | 2006107779 | A2 | 10/2006 |
| WO | 2010063083 | A1 | 6/2010 |

* cited by examiner

FOOTWEAR WITH TOE ALIGNER STRUCTURE

CROSS REFERENCE TO RELATED APPLICATION

The present application claims the benefit from earlier filed U.S. Provisional Patent Application No. 61/282,300 filed Jan. 15, 2010, which is incorporated herein in its entirety by reference.

FIELD OF THE INVENTION

The present teachings relate to footwear for wellness that helps to align the foot in a biomechanically correct position. In particular, the present teachings relate to footwear having a toe aligner structure between the big toe and the remaining toes that positions the big toe into alignment with the first metatarsal joint while allowing the toes to move freely and independently. The footwear also includes a securing structure that prevents the foot from shifting off of a footbed. The footwear promotes proper gait and strong feet which in turn helps to prevent upper body injuries.

BACKGROUND OF THE INVENTION

Modern footwear often has toe boxes that are too narrow for the toes of a wearer to spread out and work as nature intended. Such footwear can confine the foot thereby deforming and misaligning the foot and toes over time. In particular, the toes can be forced to angle into each other, causing the big toe to point inward towards the remaining toes rather than fanning out to stabilize the body when in a standing position or in motion. This phenomenon can be observed by referring to FIGS. 1A and 1B which compare a healthy aligned foot with a misaligned foot, respectively. The misaligned foot is characterized in FIG. 1B as having a relatively large hallux valgus angle, HV.

Modern footwear has been shown to cause or worsen foot ailments such as, but not limited to, bunions, plantar fasciitis, hallus valgus, heel spurs, bone spurs, corns, tailors bunions, hammer toes, nueromas, and collapsed arches. Ailments of the foot often correspond to upper body ailments such as, for example, skeletal and muscular misalignment in ankles, knees, hips, back, and neck.

In a healthy foot, the toes move and spread out to help balance the body and distribute pressure on the foot. This enables the arch, tendons, bones and muscles of the foot to work in conjunction to support the body. It is the big toe that acts as a counterbalance to the remaining toes and the heel. The big toe, remaining toes, and heel operate to anchor the arch of the foot to support the body. As in any structure that forms an arch, such as a bridge for example, the arch can support tremendous amounts of weight from above. But if pressure is applied from beneath the curve of the arch, the arch is easily weakened and can collapse. This concept also applies to an arch of the foot and it is why that for so many people the use of an arch support can actually weaken the strength of the foot.

In addition to anchoring the arch, the position of the big toe is crucial during toe-off at the end of the natural gait cycle when walking or running. The big toe supports the weight of the body when pushing off at the end of a stride. If the big toe is not properly aligned, the first metatarsal joint bears the weight of the body and over time the foot goes out of alignment. The misalignment is shown in FIG. 1B where the big toe, first metatarsal joint, and heel are not arranged in a straight line. This misalignment prevents the big toe from acting as the counterbalance to the remaining toes and the heel. This can result in the formation of a bunion, plantar fasciitis, collapsed arches, hammertoes, and other ailments.

Accordingly, there exists a need for footwear that can realign a foot by moving the toes and foot into their healthiest position in order to counteract the damage that modern footwear can cause. Such footwear can be beneficial for the foot when standing, walking, running, swimming, and during other activities where the muscles of the foot are in use.

SUMMARY OF THE INVENTION

The present teachings provide footwear for wellness including a sole and a securing upper. The securing upper can be arranged with the sole and configured to securely hold a foot of a user on a footbed of the sole so as to substantially prevent lateral movement of the foot with respect to the footbed and allow one or more of a big toe and remaining toes of the user to be at least partially uncovered and exposed. A toe aligner structure can be arranged between the securing upper and the sole and configured to extend between the big toe and remaining toes of the user so as to direct a force against the big toe in a direction away from the remaining toes during standing, walking, running, swimming, and other movements when muscles of the foot are in use.

The present teachings also provide footwear for wellness including a sole and a contoured footbed. The contoured footbed can be shaped to receive a foot of a user and substantially prevent lateral movement of the foot with respect to the footbed. An upper can be arranged with the sole and configured to allow one or more of a big toe and remaining toes of the user to be at least partially uncovered or exposed. A toe aligner structure can be arranged with the sole and configured to extend between the big toe and remaining toes of the user so as to direct a force against the big toe in a direction away from the remaining toes during standing, walking, running, swimming, and other movements when muscles of the foot are in use.

The present teachings further provide footwear for wellness including a sole and a securing upper. The securing upper can arranged with the sole and configured to securely hold a foot of a user on a footbed of the sole so as to substantially prevent lateral movement of the foot with respect to the footbed and allow one or more of a big toe and remaining toes of the user to be at least partially uncovered and exposed. A toe aligner structure can be arranged with the sole and configured to extend between the big toe and remaining toes of the user so as to direct a force against the big toe in a direction away from the remaining toes during standing, walking, running, swimming, and other movements when muscles of the foot are in use.

Additional features and advantages of various embodiments will be set forth, in part, in the description that follows, and will, in part, be apparent from the description, or may be learned by the practice of various embodiments. The objectives and other advantages of various embodiments will be realized and attained by means of the elements and combinations particularly pointed out in the description herein.

It is to be understood that both the foregoing general description and the following detailed description are exemplary and explanatory only, and are intended to provide an explanation of various embodiments of the present teachings.

DETAILED DESCRIPTION OF THE PREFERRED EMBODIMENTS

Figure 1A:
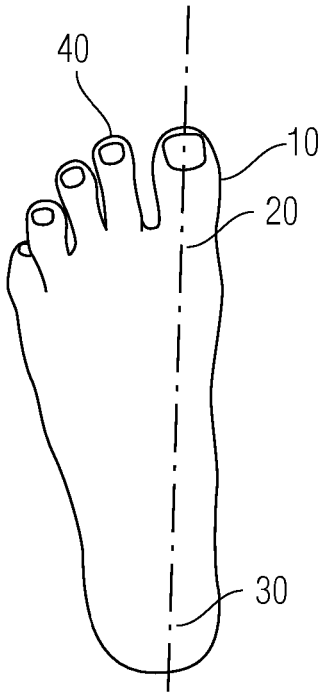
FIG. 1A shows a healthy foot where the big toe, first metatarsal joint, and heel are in alignment.
Figure 1B:
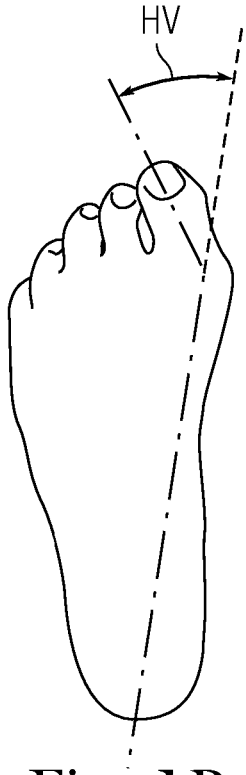
FIG. 1B shows a misaligned foot having a relatively large hallux valgus angle, HV.
Figure 2A:
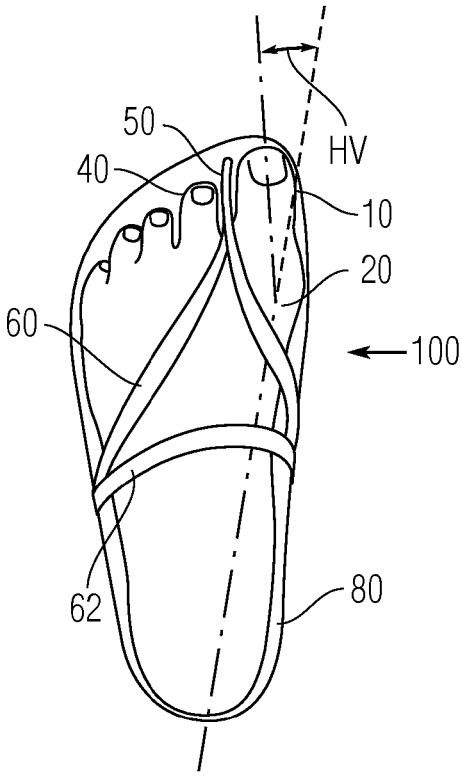
FIG. 2A shows a foot secured within the footwear of the present teachings and firmly held in a proper position on the footbed.

The present teachings relate to footwear 100 for wellness that includes a toe aligner structure 50 that operates to position the big toe 10, first metatarsal joint 20, and heel 30 in a straight line. FIG. 2A shows a foot secured within footwear 100 of the present teachings and securely and squarely held on the footbed 80 by way of a robust securing structure 60, which in this case includes an adjustable strap assembly that extends across the midpoint of the foot and attaches to the sole. During standing, walking, running and other movements, the toe aligner structure 50 of the footwear 100 works in conjunction with the securing structure 60 to secure the foot on the footbed 80 of the sole and provide alignment of the foot in a biomechanically correct position while allowing the toes to move freely and independently.

The structure of the footwear 100 promotes proper gait and strong feet by activating the foot muscles while they are in active proper alignment, thereby exercising and strengthening the foot. In this regard, the footwear 100 of the present teachings operates to realign the foot by actively lessening the hallux vallgus angle, HV, which is the angle formed between the axis of the big toe 10 and the first metatarsal joint 20 of the foot.

Figure 2B:
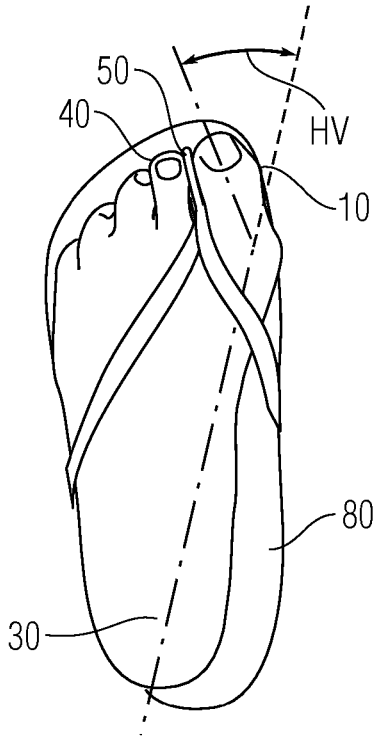
FIG. 2B shows a foot that is loosely held on the footbed and shifted with respect thereto so as to be in an improper position with respect to the footbed.

As shown in FIG. 2B, the force that the toe aligner structure 50 exerts on the big toe 10 away from the remaining toes can cause the foot to shift off of the footbed 80, whereby the heel 30 of the foot tends to move towards the outside, or lateral side, of the footbed 80. As will be discussed below, a securing structure 60 of the footwear 100 is designed to exert enough securing force so as to firmly hold and position a foot squarely on the footbed 80 during standing, walking, running and other movements thereby allowing little or no lateral movement with respect to the footbed 80.

Referring to FIGS. 2A and 3A-3C, the securing structure 60 can include a securing upper 62 that is arranged to securely hold the foot on the footbed 80 against the force exerted on the big toe 10 by the toe aligner structure 50. The securing upper 62 substantially prevents lateral shifting of the foot with respect to the footbed 80 when the footwear 100 is being worn during standing, walking, running and other movements. As such, the securing upper 62 can include relatively robust straps that can hold and retain the foot on the footbed 80. The footbed 80 can be substantially flat or can be contoured as discussed below. The securing upper 62 thereby operates to allow all of the force exerted by the toe aligner structure 50 to be directed against the big toe 10 to thereby position the big toe 10 in alignment with the first metatarsal joint during walking and running.

In addition to or in the alternative, the securing structure 60 of the footwear 100 of the present teachings can include a contoured footbed 82 that is designed to receive and securely hold the foot on the footbed 80 of the sole 70 with little or no lateral movement. As will be discussed in more detail below with respect to at least FIGS. 3A-3C, the contoured footbed 82 can include one or more of a fully sunken footbed, a sunken heel-cup, partially or fully raised side walls, a hammertoe pad, a modest arch, a toe guard and/or any other additional structure that can help the foot stay properly aligned on the footbed. The contoured footbed 82 can be arranged to support a portion of the foot, as in the case of a sunken heel-cup, or can be arranged to support the entire bottom portion of the foot. Similar to the securing upper 62, the contoured footbed 82 operates to secure the foot in place on the footbed 80, thereby allowing all of the force exerted by the toe aligner structure 50 to be directed on the big toe 10 to position the big toe 10 into alignment with the first metatarsal joint 20.

The footbed 80 or the contoured footbed 82 can be integrally formed with the sole 70, or can be formed as a separate piece from the sole 70.

The toe aligner structure 50 of the present teachings is shaped and arranged to create a force that is exerted on a misaligned big toe in a direction away from the remaining toes in order to separate the big toe 10 from the other toes. The toe aligner structure 50 can be a semi-rigid structure that is securely supported on the sole 70 of the footwear 100 so that it does not shift or move when in contact with the big toe 10, or any other of the toes. The toe aligner structure 50 can vary in length, shape, and position on the footbed 80 of the sole 70. Various shapes of the toe aligner structure 50 are shown in FIGS. 7A-7C, 9A-9F, and 10A-10E, but are not limited to those shown.

Figure 9A:
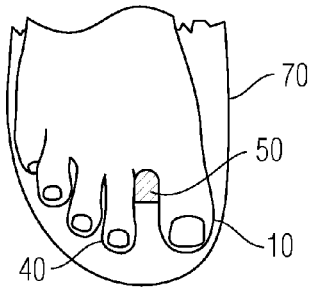
FIGS. 9A-9F show top views of various different shapes and arrangements of toe aligner structures in conjunction with a wearer's foot according to various embodiments.
Figure 9B:
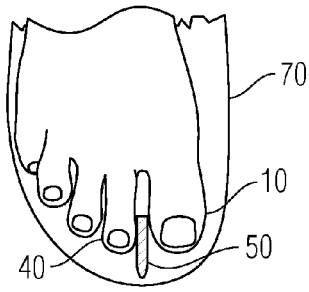
Figure 9C:
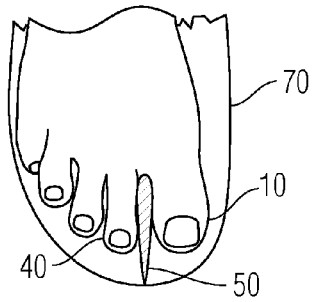
Figure 9D:
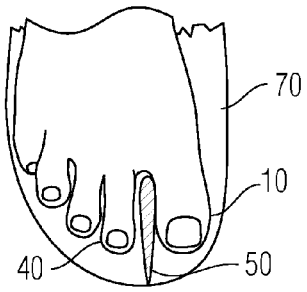
Figure 9E:
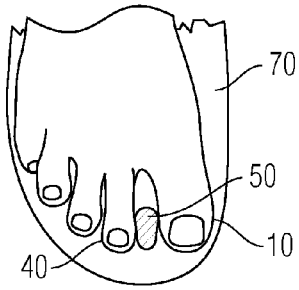
Figure 9F:
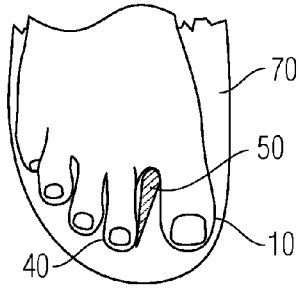
Figure 10A:
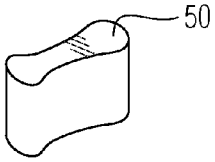
FIGS. 10A-10E show perspective views of various shapes of toe aligner structures according to various embodiments.
Figure 10B:
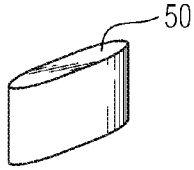
Figure 10C:
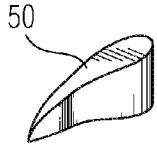
Figure 10D:
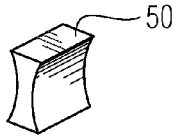
Figure 10E:
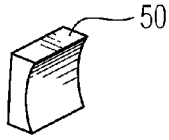

As shown in FIGS. 9C and 9D, the toe aligner structure 50 can extend lengthwise between the big toe 10 and the second toe 40, and can run along the entire length of the big toe 10. The toe aligner structure 50 can also run from the front tip of the sole 70 of the footwear 100 to the crease between the big toe 10 and second toe 40 (where the thong of a flip flop typically resides). As shown in FIG. 9B, the toe aligner structure 50 can be truncated in length while still being capable of straightening the big toe 10. In such a case, the toe aligner structure 50 can be truncated in a manner that it does not extend all the way to the crease between the big toe 10 and the second toe 40. The toe aligner structure 50 can also run along the middle length of the big toe 10 in any length, shape, or width that puts the big toe 10 in alignment. For example, the toe aligner structure 50 can be placed anywhere along the space between the big toe 10 and remaining toes, such as shown in FIG. 9E. The toe aligner structure 50 can also be placed at any angle on the footbed 80 as in FIG. 9F so as to accommodate different severities of hallux valgus deformities, as relatively more severe foot deformities can result in the inability to straighten the toes completely. Conversely, for some foot types, a toe aligner structure 50 can be angled to create more of a spread between the big toe 10 and the remaining toes. As shown in FIGS. 10D and 10E, the toe aligner structure 50 can be shaped to accommodate the silhouette of the inside of the big toe 10 and/or the second toe 40.

The implementation of the toe aligner structure 50 in footwear which lacks a full upper such as the footwear 100 of the present teachings allows the toes of the foot to move freely and independently without friction in a vertical and horizontal direction. As a result, when the footwear 100 is being worn, the main point of contact can be on the inner side surface of the big toe 10 while the remaining surfaces of the toes are uncovered and free from points of friction that can result in ailments such as corns, blisters, ingrown nails, and the like. The toe aligner structure 50 allows a wearer's big toe 10 to move substantially independently from the remaining toes while aligning the big toe 10, first metatarsal joint 20, and heel 30. The alignment and independent movement of the big toe 10 is important when the wearer is standing and during toe-off at the end of the natural gait cycle as it allows the wearer to simulate barefoot walking and running. At the same time, the securing upper 62 and/or the contoured footbed 82 act as stabilizing elements to keep the foot firmly planted on the footbed 80 and prevent the foot from shifting off of the footbed 80.

As discussed above, the design of the footwear 100 of the present teachings allows the force exerted by the toe aligner structure 50 to be directed against the big toe 10. During use, this force realigns the foot by lessening the hallux valgus angle, HV, formed between the big toe 10 and the first metatarsal joint 20, as shown in FIG. 2A. The force exerted on the big toe 10 by the toe aligner structure 50 trains the foot muscles to support the foot in proper alignment without excessive arch support. This realignment can relieve or reduce the pain and discomfort associated with foot ailments caused by modern footwear, such as a non-aligned big toe, plantar faciitis, collapsed arches, and the like.

The footwear 100 of the present teachings allows the wearer to actively strengthen the foot by activating and exercising the muscles in proper alignment during standing, walking, running, and other movements. This is in contrast to known footwear which can promote alignment of the toes only when the wearer is at rest.

At the same time, the structure of the footwear 100 of the present teachings allows the toes to be partially exposed. The open nature of the footwear 100 prevents frictional rubbing against a full upper during standing, running, walking and other movements which can result in the formation of corns, calluses, and bunions. This is in contrast to known footwear that includes enclosed pockets for one or more of the toes of the foot. Such pockets do not allow the toes to move freely without friction, in particular, vertically up or down, or horizontally away from the foot.

According to various embodiments, the footwear 100 of the present teachings allows a wearer's big toe to move and flex substantially independently from the remaining toes while aligning the big toe 100 with the first metatarsal joint 20 and heel 30. The footwear 100 can have wellness, recovery, and therapeutic qualities, can be made fashionably, and can be easily put on and removed from a wearer's foot. The footwear 100 can be used in wet situations such as at the beach or in a locker room. Furthermore, the features of the footwear 100 of the present teachings can be easily incorporated into other footwear styles without detracting from the shoes appearance.

Figure 3A:
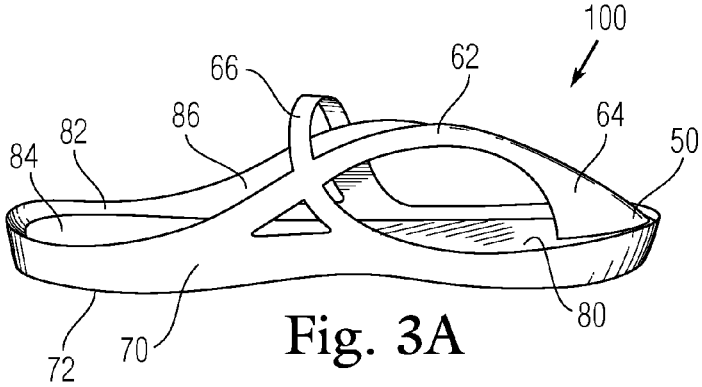
FIGS. 3A and 3B show alternative side views of the footwear of the present teachings including a thong-like upper according to a preferred embodiment.
Figure 3B:
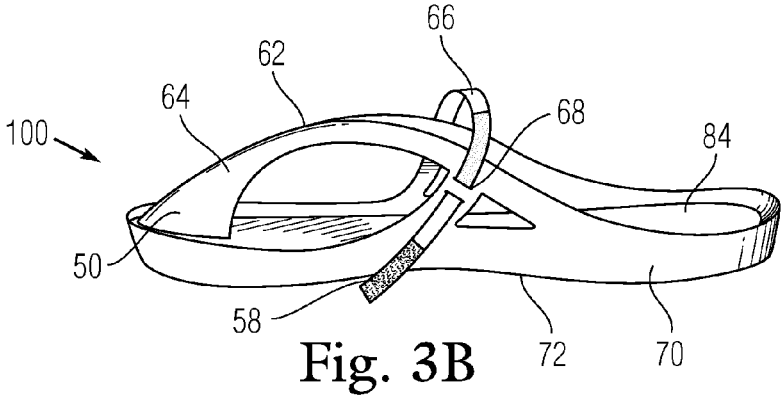

FIG. 3A shows a preferred embodiment of the footwear 100 including the toe aligner structure 50 being paired with a securing upper 62 that includes a thong-like upper in the form of a sandal-type shoe. The thong-like upper 62 can have a plurality of straps including an adjustable strap 66 that is arranged to extend from one side of the sole 70 and across the mid-foot section of the foot. The straps of the thong-like upper 62 are arranged to firmly secure the foot in place on the footbed 80 of the sole 70 in a manner that prevents lateral shifting of the foot during standing, walking, swimming, running, and other movements.

All or a portion of the footbed 80 of the footwear 100 of the preferred embodiments can be sunken to form a contoured footbed 82. The contoured footbed 82 can provide lateral support to the foot to substantially prevent shifting of the foot during standing, walking, running, and other movements. The contoured footbed 82 can include one or more of a fully sunken footbed 82, a sunken heel-cup 84, partially or fully raised side walls 86, a hammertoe pad, a modest arch 88, a partial toe guard 94, a full toe guard 96, and/or any other additional structure that can help the foot stay properly aligned on the footbed 80. As shown on the upper 62 of FIG. 3A, the raised side walls 86 can also be integrally formed as part of the upper 62.

The toe aligner structure 50 of the footwear 100 can be in the form of a semi-rigid structure. The toe aligner structure 50 can be attached on one end to a lower surface of a thong strap 64 of the thong-like upper 62. The other end of the toe aligner structure 50 can be firmly attached to the footbed 80 of the sole 70.

According to various embodiments, the toe aligner structure 50 can be attached to the sole 70 on one end and unconnected to the securing upper 62 on its opposite end. The toe aligner structure 50 can be arranged to extend substantially perpendicularly to the sole 70, along the length of the big toe 10 and between the big toe 10 and the second toe 40, so as to separate the big toe 10 from the remaining toes. The toe aligner structure 50 can be placed at variable angles with respect to the sole 70 and the thong strap 64. The toe aligner structure 50 can have various different shapes, lengths, thicknesses, and widths depending on the size of a wearer's foot, see FIGS. 9A-9F and 10A-10E. The toe aligner structure 50 can be integrally formed with the thong strap 64 of the securing upper 62. The toe aligner structure 50 can be made of the same material as the thong strap 64 or can be made of a different material. The toe aligner structure 50 can be integrally formed with the footbed 80 and/or the sole 70. The toe aligner structure 50 can be made of the same material as the footbed 80 and/or the sole 70, or can be made of a different material. The toe aligner structure 50 can be made of various different materials, such as injection-molded EVA, compression molded EVA, stretch cloth, rubber, leather, synthetic leather, and the like.

Figure 3C:
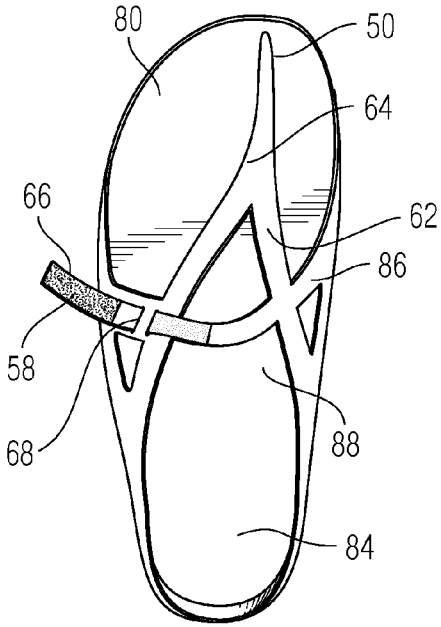
FIG. 3C shows a top view of the footwear of FIGS. 3A and 3B.

As best shown in FIG. 3C, the securing upper 62 can include adjustable strapping so that the footwear 100 can readily provide a customized fit. The adjustable strapping can include an adjustable strap 66 that extends from one side of the sole 70 and threads through an aperture 68 formed on the other side of the securing upper 62. The adjustable strap 66 can be tightened against a foot and secured back against itself via a hook and loop-type fastener arrangement 58, or any other fastener arrangement as would be known in the art. Alternatively, the securing upper 62 can be formed as a fixed strapping that is non-adjustable. The securing upper 62 can be made of the same material as the toe stabilizer 50, such as injection-molded EVA, compression molded EVA, stretch cloth, rubber, leather, synthetic leather, and the like, or can be made of a different material.

The sole 70 of the footwear 100 can be made of a soft and flexible material or of a relatively firmer material, such as injection-molded EVA or plastic, rubber, leather, cork and the like. The sole 70 can be shaped to provide modest arch support for the foot of the wearer. In addition, the sole 70 can be provided with a deep heal cup 84 and additional cushioning for added comfort. The sole 70 can be a formed as a laminate of two or more layers of the same or different materials.

Figure 4A:
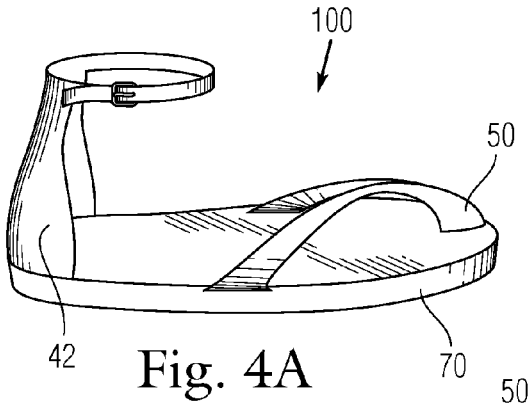
FIGS. 4A-4I show various other types of footwear incorporating a toe aligner structure and a securing structure according to various embodiments.
Figure 4B:
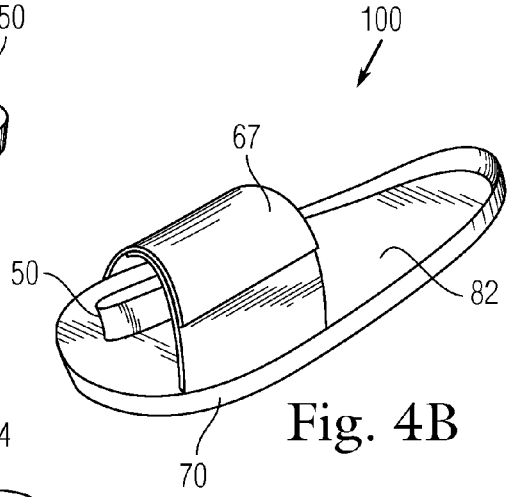
Figure 4C:
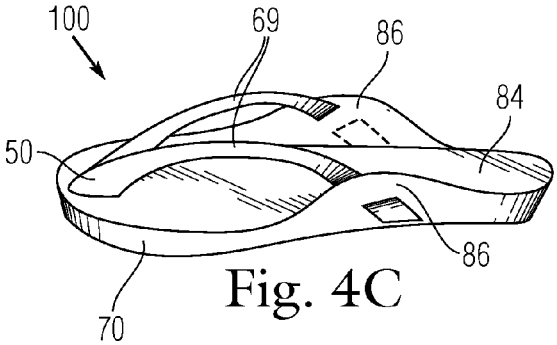
Figure 4D:
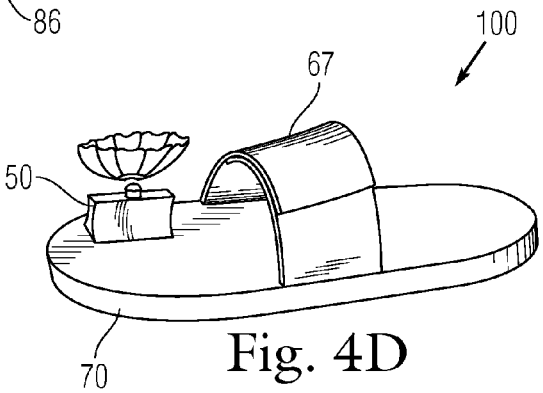
Figure 4F:
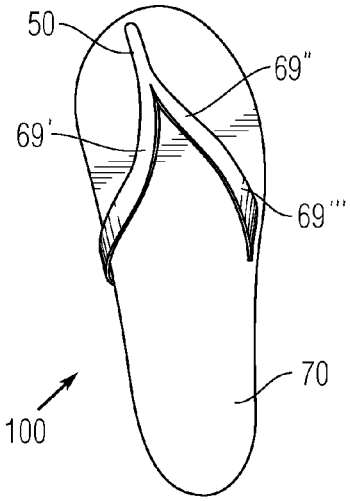
Figure 4E:
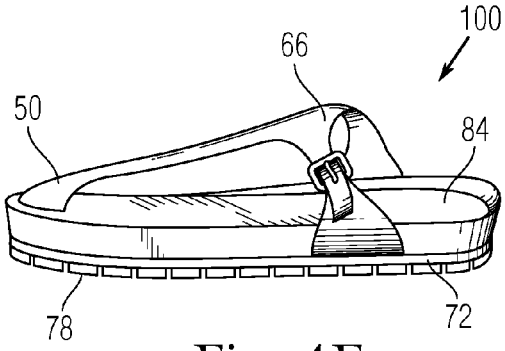

The outsole 72 of the footwear 100 of the present teachings can be provided with grooves and/or treads 78 for better grip or flexibility, as shown in the footwear 100 of FIG. 4E. The grooves and/or treads 78 of the outsole 72 can have various designs and can be of various depths, thicknesses, textures, colors, and the like. The outsole 72 can be made of various different materials, such as rubber, leather, and synthetic leather. The outsole 72 can be made of the same material as the sole 70 or can be made of various different materials, such as injection-molded latex EVA, rubber, leather, and synthetic leather. The outsole 72 can also be integrally formed with the sole 70.

According to various embodiments, the footwear 100 can be made as an integrally formed, one-piece unit. For example, the securing upper 62 and the sole 70 can be made as a one-piece unit by injection molding. Alternatively, the securing upper 62, the toe aligner structure 50, and the sole 70 of the footwear 100 can be made as separate components. For example, the footwear 100 can include a compression molded sole 70 with an integrally formed toe aligner structure 50 and a separately fabricated securing upper 62. Separate grooves and/or treads 78 can be added to the sole 70. Moreover, a separate footbed layer 80 can be overlaid onto the sole 70 for cosmetic or utility purposes such as for grip and texture. According to various embodiments, the footwear 100 can include a sole 70 with a slot to accept a separate toe aligner component 50, and a separately fabricated securing upper 62.

According to various embodiments, the footwear 100 of the present teachings is not limited to thong-type footwear, such as a sandal. The toe aligner structure 50 and the securing structure 60 can be implemented in various other types of footwear 100 as shown, for example, in FIGS. 4A-4I, FIGS. 5A-5D, FIGS. 6A-6D, and FIG. 8.

For example, FIG. 4A shows footwear 100 including a toe aligner structure 50 and a heel cap 42 which operates to secure a foot to the sole 70 and prevent shifting.

FIG. 4B shows footwear 100 including a toe aligner structure 50 extending between the sole 70 and an elongated adjustable strap 67. In addition or in the alternative, a sunken footbed 82 can be provided to secure a foot to the sole 70 to prevent shifting of the foot on the footbed 82.

FIG. 4C shows footwear 100 including a toe aligner structure 50 with raised sidewalls 86 which prevent lateral shifting of the foot on the footbed 82. In addition or in the alternative, the raised sidewalls 86 of the footwear 100 of the present teachings can include other components of a contoured footbed 82, such as a sunken heel-cup 84.

FIG. 4D shows the footwear 100 including an upwardly extending, cantilevered toe aligner structure 50 and an elongated adjustable strap 67 arranged at the midfoot to secure the foot to the sole 70 and prevent shifting.

FIG. 4E shows the footwear 100 including a toe aligner structure 50 with an adjustable strap 66 and heel cup 84 arranged to secure the foot to the sole 70. The outsole 72 is shown with grooves and/or treads 78 for better grip or flexibility.

FIG. 4F shows the footwear 100 including a toe aligner structure 50 with off-center strapping whereby one anchoring strap 69" holds the foot on a lateral side thereof and the opposite anchoring strap 69' wraps around the medial side to secure the foot to the sole 70 and prevent shifting. The strapping 69" can be constructed of a more robust girth or a more rigid durometer in the vicinity of 69'" so as to prevent lateral shifting of the foot.

Figure 4G:
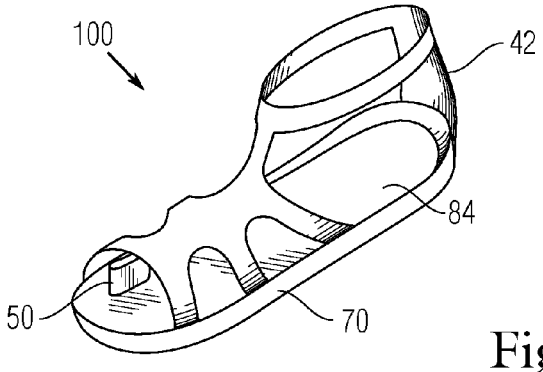

FIG. 4G shows the footwear 100 including a toe aligner structure 50 arranged with a strap arrangement which connects to a heel cap 42. The strapping arrangement and heel cap 42 operate to secure the foot to the sole 70 and prevent shifting. In an alternative, the heel cap 42 can be widened so as to provide substantial structure around the heel of a foot so that it can prevent lateral shifting without the addition of a contoured footbed, such as a sunken heel-cup 84.

Figure 4H:
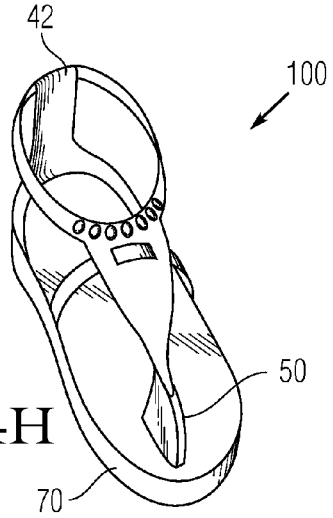

FIG. 4H shows the footwear 100 including a toe aligner structure 50 arranged with another strap arrangement which connects to a heel cap 42 which operates to secure the foot to the sole 70 and prevent shifting.

Figure 4I:
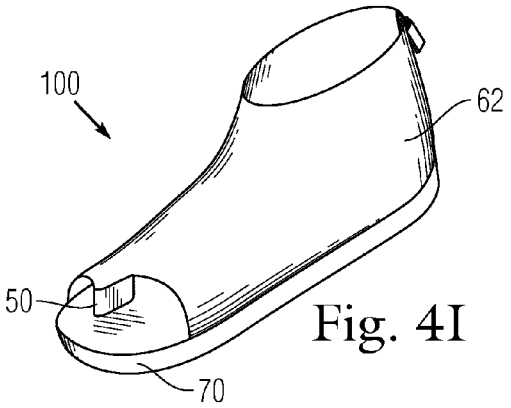

FIG. 4I shows the footwear 100 including a toe aligner structure 50 arranged with a securing upper 62 formed by one contiguous piece implemented as a covered, gladiator-style shoe that secures the foot to the sole 70 and prevents shifting.

FIGS. 5A-5D show a toe aligner structure 50 implemented in gladiator-style footwear 110, wedge-style footwear 120, an open-toe pump 130, and covered, gladiator-style footwear 140, respectively. Similar to the thong footwear shown in FIGS. 3A-3C, the toe aligner structure 50 can be arranged to extend substantially perpendicularly to the footbed 80 of the sole 70 and along the length of the big toe 10, between the big toe 10 and the remaining toes for aligning the big toe 10 with the metatarsal joint 20.

Figure 5A:
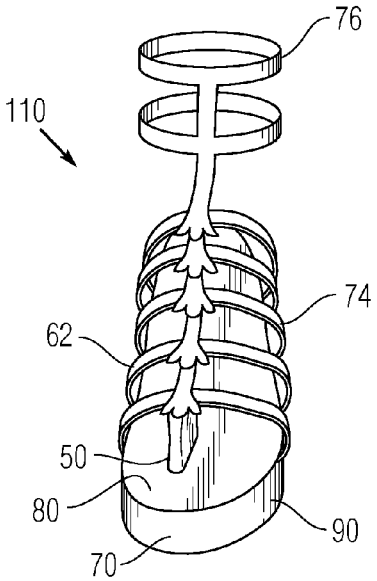
FIG. 5A shows a toe aligner structure incorporated in a gladiator-style footwear according to various embodiments.
Figure 5B:
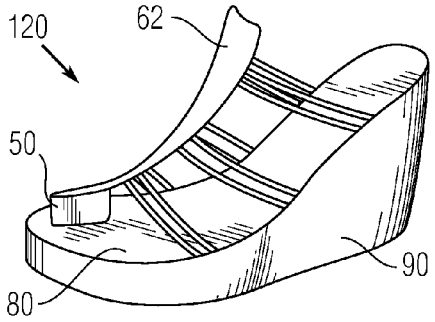
FIG. 5B shows a toe aligner structure incorporated in a wedge-style footwear according to various embodiments.
Figure 5C:
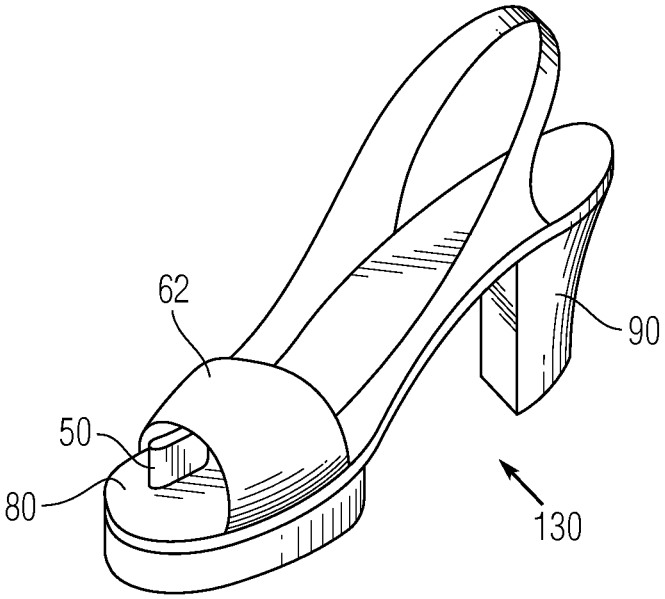
FIG. 5C shows a toe aligner structure incorporated in an open-toe pump according to various embodiments.
Figure 5D:
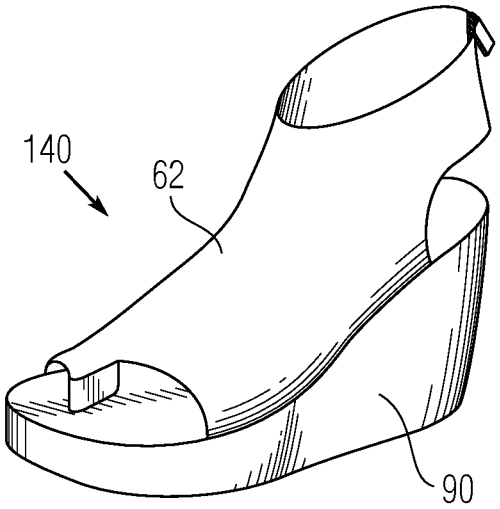
FIG. 5D shows a toe aligner structure incorporated in a covered gladiator-style footwear according to various embodiments.

As shown in the gladiator-style footwear 110 of FIG. 5A, the securing upper 62 can include a plurality of foot straps 74 and a plurality of ankle straps 76. The securing upper 62 can also be one contiguous piece as implemented in the covered, gladiator-style footwear 140 of FIG. 5D. In each of the footwear 110, 120, 130, and 140, the straps are not limited to the number and widths shown, and can include any number of foot or ankle straps 74, 76. The straps 74, 76 can be made of various different materials, such as plastic, leather, synthetic leather, and the like.

The footwear 110, 120, 130, and 140 can include a wedge heel 90 or any other type of heel 90, for example, a platform heel, a spike heel, and the like. The heel 90 can be of various different heights and widths. In use, the pressure of the body directed onto the wearer's foot at an angle resulting from the shape of the heel 90 can supplement the securing upper 62 as a holding force to firmly secure the foot to the footbed 80 to prevent shifting. In addition, any of the other footwear 100 disclosed herein could include a wedge heel, platform heel, spike heel, and the like.

Figure 6A:
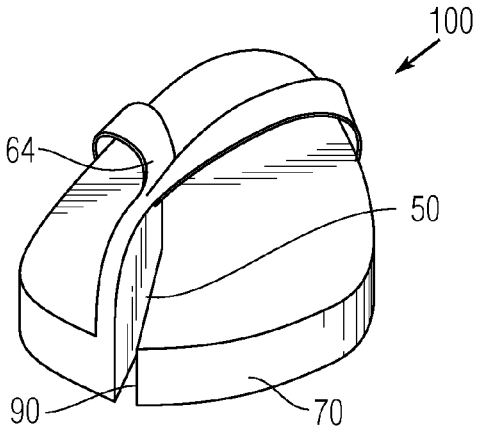
FIGS. 6A-6E show various embodiments of a footwear including a split sole arrangement.

Referring to FIGS. 6A-6E, the footwear 100 of the present teachings can also include a split sole according to various embodiments. As shown in FIG. 6A, the split sole can be formed by way of a cut 90 through the sole 70 in the vicinity of the toe aligner structure 50. The implementation of the cut 90 to create the split sole can provide additional independent movement for the big toe 10 both laterally and horizontally with respect to the remaining toes during standing, walking, running, and other movements.

Figure 6B:
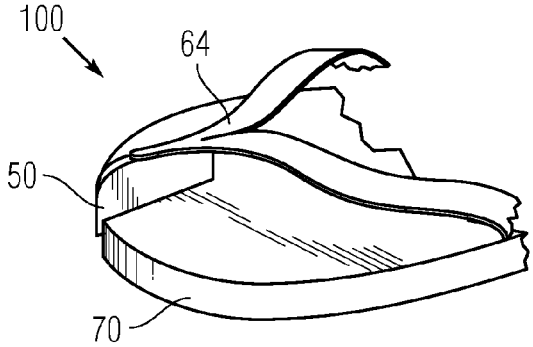

As shown in FIGS. 6A and 6B, the toe aligner structure 50 can be attached to the lower surface of the thong strap 64 on one end and the footbed 80 of the sole 70 on the other end in the vicinity of the cut 90. The toe aligner structure 50 can be integrally formed with the thong strap 64. The toe aligner structure 50 can be integrally formed with the sole 70, or can be its own separate structure. The toe aligner structure 50 can be arranged to extend substantially perpendicularly to the sole 70, or at any angle, along the length of the big toe 10. Moreover, the toe aligner structure 50 can extend between the big toe 10 and the second toe 40 so as to separate the big toe 10 from the remaining toes.

Figure 6C:
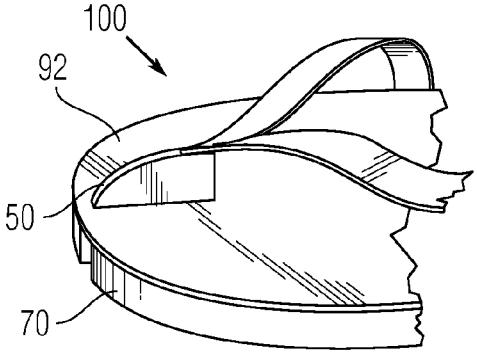

As shown in FIG. 6C, the upper surface of the sole 70 can include an overlay 92. The overlay 92 can be secured to the upper surface of the sole 70 so as to cover over the cut 90 that creates the split sole. The overlay 92 can be made of various different materials, such as leather, synthetic leather and rubber. The overlay 92 can be integrally formed with the sole 70 or can be secured as a separate piece as shown in FIG. 6C.

Figure 6E:
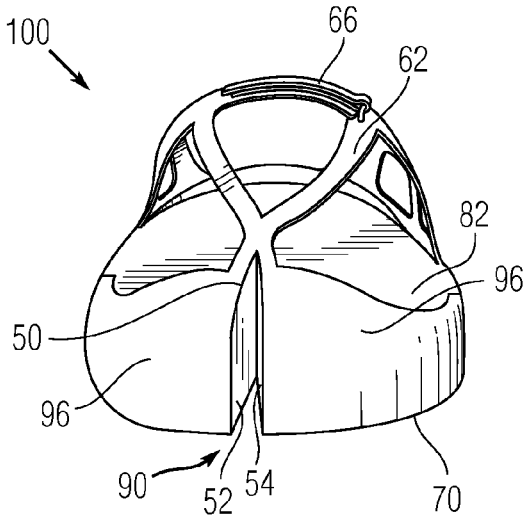
Figure 6D:
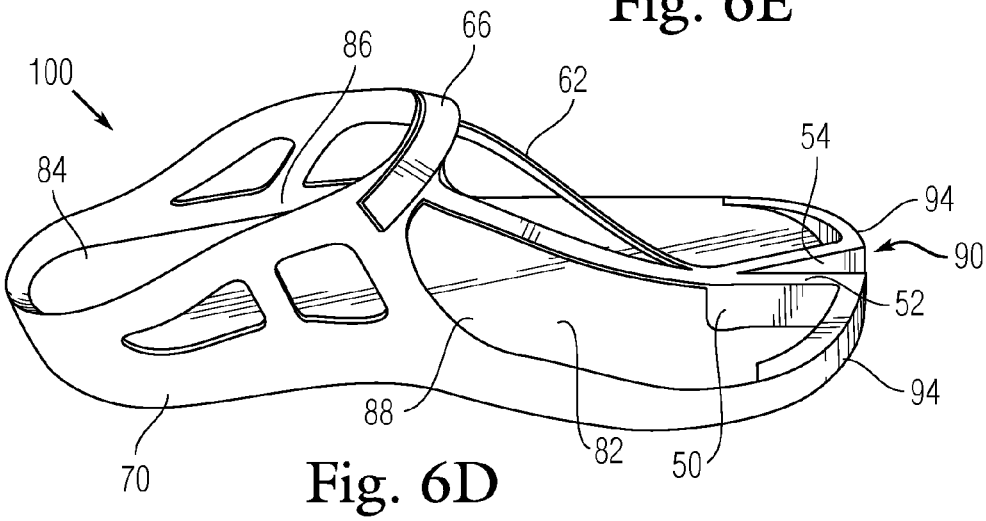

FIGS. 6D and 6E show the footwear 100 according to various embodiments that include a toe aligner structure 50 arranged as a split toe aligner. As best shown in FIG. 6E, the split toe aligner 50 can include two aligning structures 52, 54 that extend outwardly in a general V-shape between the split or cut 90 formed in the sole 70. When the footwear 100 is placed on a foot of a wearer, the split toe aligner 50 operates to separate the big toe 10 from the remaining toes such that the aligning structure 52 creates a force that is exerted on a misaligned big toe 10 in a direction away from the remaining toes.

Referring to FIG. 6D, the footwear 100 can also be provided with a partial toe guard structure 94 that extends from the front portion of the sole 70 and turns upwardly in a manner that can partially protect one or more of the front toes of the wearer.

Referring to FIG. 6E, the footwear 100 can alternatively be provided with a full toe guard structure 96 that extends from the front portion of the sole 70 and turns upwardly in a manner that can fully protect one or more of the front toes of the foot of the wearer.

The footwear 100 of FIGS. 6D and 6E can also include a thong-like securing upper 62 having an adjustable strap 66 that is arranged to extend across the mid-foot area to secure the foot in place on the sole 70 to prevent lateral shifting. The footwear 100 can include a contoured footbed 82 including one or more of a fully or partial sunken footbed, a sunken heel-cup 84, partial or fully raised side walls 86, a hammertoe pad, a modest arch 88, or any other additional structure that can help the foot to align properly with the footbed.

Figure 7A:
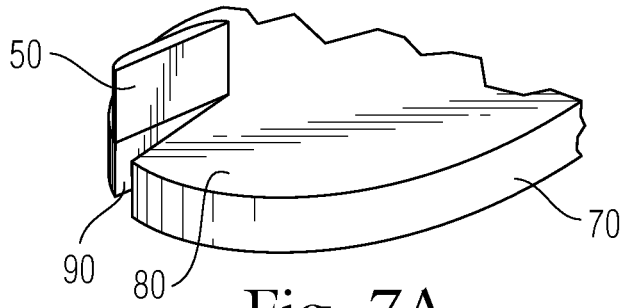
FIGS. 7A-7C show various different embodiments of the toe aligner structure as arranged on footwear having a split sole.
Figure 7B:
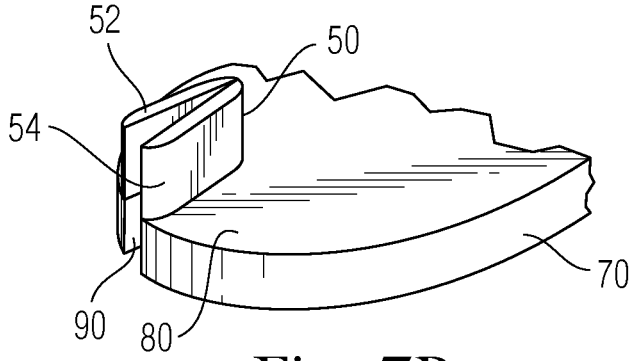
Figure 7C:
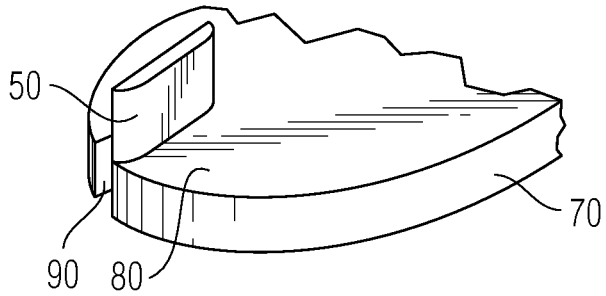

FIGS. 7A-7C show various different embodiments of the toe aligner structure 50 as arranged on a sole 70 having a split sole.

Figure 8:
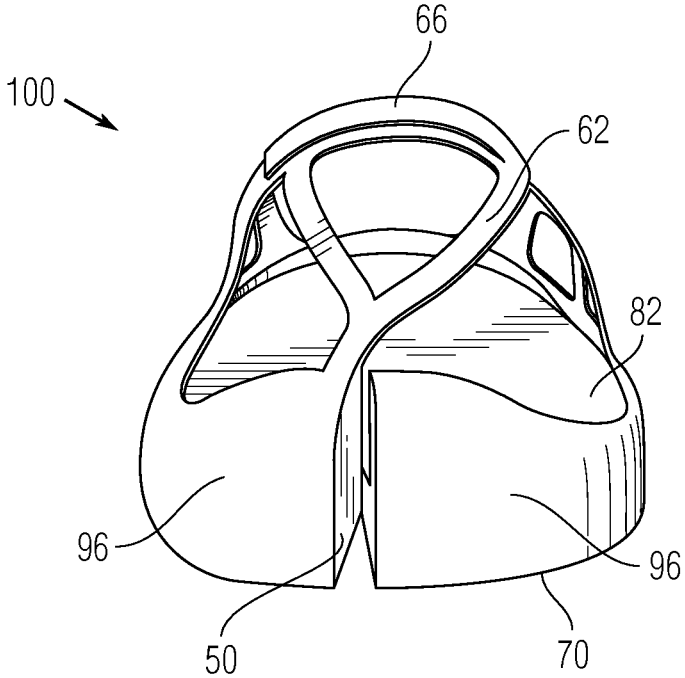
FIG. 8 shows the footwear of the present teachings including a toe aligner structure arranged on a big toe side of a split sole.

Specifically, FIG. 7A shows a perspective view of a toe aligner structure 50 formed as an elongated plate arranged on the big toe side of the cut 90 through the sole 70. Footwear 100 incorporating such a toe aligner structure 50 is shown in FIG. 8. This footwear 100 can be made as a unitary injection-molded piece or in various pieces.

FIG. 7B shows a perspective view of the split toe aligner 50 including two aligning plates 52, 54 arranged in a V-shape. Such a split toe aligner 50 is incorporated in the footwear 100 shown in FIGS. 6D and 6E. Each aligning plate 52, 54 can be arranged on either side of the cut 90 in the sole 70.

FIG. 7C shows a perspective view of a toe aligner structure 50 formed as an elongated plate arranged on the remaining toe side of the cut 90 through the sole 70.

FIGS. 9A-9D show top views of various different shapes and arrangements of toe aligner structures 50 in conjunction with a wearer's foot according to various embodiments.

FIGS. 10A-10E show perspective views of various shapes of toe aligner structures 50 according to various embodiments.

The footwear 100 of the present teachings was inspired by the barefoot walking and running movement which promotes biomechanically correct movement of the foot as nature intended in order to provide proprioceptive feedback to the body. Known footwear in this category currently does not address a large portion of the population that already suffers from foot ailments and cannot go barefoot. The footwear 100 of the present teachings allows a wearer's big toe to move independently from the remaining toes while aligning the big toe with the first metatarsal and heel without the friction from a full upper. This realigns the foot to move in its healthiest position in order to counteract the damage that modern footwear can cause.

One skilled in the art can appreciate from the foregoing description that the present teachings can be implemented in a variety of forms. Therefore, while these teachings have been described in connection with particular embodiments and examples thereof, the true scope of the present teachings should not be so limited. Various changes and modifications may be made without departing from the scope of the teachings herein.

What is claimed is:

1. Footwear for wellness comprising:

a sole including a front foot portion;

a securing upper arranged with the sole and configured to securely hold a foot of a user on a footbed of the sole so as to substantially prevent lateral movement of the foot with respect to the footbed and allow one or more of a big toe and remaining toes of the user to be at least partially uncovered and exposed; and a toe aligner structure arranged between the securing upper and the sole at the front foot portion thereof and configured to extend between the big toe and remaining toes of the user so as to direct a force against the big toe in a direction away from the remaining toes during standing, walking, running, swimming, and other movements when muscles of the foot are in use;

wherein the securing upper includes a strap assembly, the strap assembly including off-center strapping including a first anchoring strap configured to hold the foot of the user on a lateral side thereof and a second anchoring strap configured to wrap around the foot of the user on a medial side thereof, wherein first ends of the first and second anchoring straps are joined and secured to the toe aligner structure, the first anchoring strap having a second end secured to a top portion of the footbed at a location rearward of the front foot portion of the sole and the second anchoring strap having a second end secured to a side portion of the sole at a location rearward of the front foot portion thereof.

2. The footwear of claim 1, wherein the footbed of the sole is contoured in a shape to receive a foot of a user so as to substantially prevent lateral movement of the foot with respect to the footbed.

3. The footwear of claim 1, wherein the securing upper includes an adjustable strap that extends about a mid-foot portion of the sole.

4. The footwear of claim 1, wherein the sole includes a split sole.

5. The footwear of claim 4, wherein the split sole includes an overlay.

6. The footwear of claim 4, wherein the toe aligner structure includes a V-shape.

7. The footwear of claim 4, further including a toe guard extending from a front portion of the sole.

8. The footwear of claim 1, wherein the sole includes an elevated heel.

9. Footwear for wellness comprising:

a sole including a front foot portion;

a securing upper arranged with the sole and configured to securely hold a foot of a user on a footbed of the sole so as to substantially prevent lateral movement of the foot with respect to the footbed and allow one or more of a big toe and remaining toes of the user to be at least partially uncovered and exposed; and a toe aligner structure arranged between the securing upper and the sole at the front foot portion thereof and configured to extend between the big toe and remaining toes of the user so as to direct a force against the big toe in a direction away from the remaining toes during standing, walking, running, swimming, and other movements when muscles of the foot are in use;

wherein the securing upper includes a strap assembly, the strap assembly including off-center strapping including a first anchoring strap and a second anchoring strap, wherein first ends of the first and second anchoring straps are joined and secured to the toe aligner structure, the first anchoring strap having a second end secured to the sole at a first location and the second anchoring strap having a second end secured to the sole at a second location, the first location being closer to a longitudinal centerline axis of the footwear than the second location;

wherein the second end of the first anchoring strap is arranged to secure to a top portion of the footbed at a location rearward of the front foot portion of the sole; and wherein the second end of the second anchoring strap is arranged to secure to a side portion of the sole at a location rearward of the front foot portion thereof.

10. The footwear of claim 9, wherein the securing upper includes an elongated adjustable strap that extends about a midfoot portion of the sole.

11. The footwear of claim 9, wherein the footbed of the sole is contoured in a shape to receive a foot of a user so as to substantially prevent lateral movement of the foot with respect to the footbed.

12. The footwear of claim 9, wherein the sole includes a split sole.

* * * * *